US007729624B2

(12) United States Patent
Zehentbauer et al.

(10) Patent No.: US 7,729,624 B2
(45) Date of Patent: Jun. 1, 2010

(54) METHOD AND DEVICE FOR TRANSPORTING TONER MATERIAL, PREFERABLY IN AN ELECTROPHOTOGRAPHIC PRINTER OR COPIER

(75) Inventors: Martin Zehentbauer, Gauting (DE); Bernd Hausmann, Maisach (DE)

(73) Assignee: Oce Printing Systems GmbH, Poing (DE)

( * ) Notice: Subject to any disclaimer, the term of this patent is extended or adjusted under 35 U.S.C. 154(b) by 916 days.

(21) Appl. No.: 10/561,549

(22) PCT Filed: Jun. 25, 2004

(86) PCT No.: PCT/EP2004/006926

§ 371 (c)(1),
(2), (4) Date: Sep. 28, 2006

(87) PCT Pub. No.: WO2004/114025

PCT Pub. Date: Dec. 29, 2004

(65) Prior Publication Data

US 2007/0065163 A1 Mar. 22, 2007

(30) Foreign Application Priority Data

Jun. 25, 2003 (DE) ..... 103 28 600

(51) Int. Cl.
*G03G 15/08* (2006.01)

(52) U.S. Cl. ..... 399/27; 399/258

(58) Field of Classification Search ..... 399/27, 399/258

See application file for complete search history.

(56) References Cited

U.S. PATENT DOCUMENTS

| | | | | |
|---|---|---|---|---|
| 5,329,340 | A | 7/1994 | Fukuchi et al. | |
| 5,652,947 | A * | 7/1997 | Izumizaki | 399/258 |
| 6,118,951 | A | 9/2000 | Kato et al. | |
| 6,526,236 | B1 | 2/2003 | Slattery et al. | |
| 6,889,026 | B2 | 5/2005 | Schlageter et al. | |
| 2001/0021313 | A1 | 9/2001 | Machara | |
| 2002/0110379 | A1 | 8/2002 | Reihl et al. | |
| 2003/0219263 | A1 * | 11/2003 | Tsuzuki | 399/258 |
| 2004/0037591 | A1 | 2/2004 | Schlageter et al. | |
| 2005/0117920 | A1 * | 6/2005 | Ogata et al. | 399/258 |

FOREIGN PATENT DOCUMENTS

| | | |
|---|---|---|
| DE | 198 00 930 | 2/2001 |
| DE | 102 23 231 | 12/2003 |
| DE | 102 23 232 | 12/2003 |
| EP | 1 168 098 | 1/2002 |
| EP | 1 220 051 | 7/2002 |
| JP | 2002-268359 | 9/2002 |
| JP | 2002341640 | 11/2002 |
| JP | 2003-131485 | 9/2003 |
| WO | WO 00/19278 | 4/2000 |
| WO | WO 03/000530 | 1/2003 |

* cited by examiner

*Primary Examiner*—David M Gray
*Assistant Examiner*—Ryan D Walsh
(74) *Attorney, Agent, or Firm*—Schiff Hardin LLP

(57) ABSTRACT

In a method and system for determination of a fill state of a transport reservoir for toner material, toner material is transported from a transport reservoir into a developer station with aid of a toner transport system of a printer or copier. At least a toner material quantity supplied to the developer station is detected. The detected toner material quantity is associated with the transport reservoir from which the toner material is extracted.

27 Claims, 3 Drawing Sheets

METHOD AND DEVICE FOR TRANSPORTING TONER MATERIAL, PREFERABLY IN AN ELECTROPHOTOGRAPHIC PRINTER OR COPIER

BACKGROUND

Methods for transport of toner material from a reservoir are known from German patent applications DE 102 23 231 and DE 102 23 232. Toner material is transported from a reservoir with the aid of a toner transport system of a printer or copier. A printer or copier system as well as a method in which consumable substances (in particular toner material) applied to the printer or copier with the aid of transport reservoirs (for example with the aid of toner bottles) is also known from DE 198 44 435. Such a transport reservoir contains an information medium for contact-less transfer of data and energy from a data read or write station, whereby a transponder system is proposed as an information medium.

Furthermore, a printer or copier with a plurality of modularly-arranged, exchangeable part aggregates is known from DE 197 12 798, whereby the part aggregate to be identified comprises an identification arrangement with a non-volatile memory for storage of operating data of the part aggregate associated with function-relevant operating states as well as a communication interface for detachable coupling of the identification arrangement with a process control arrangement of the printer or copier.

An image generation device with a toner refilling device is known from DE 198 00 930 C2, which toner refilling device comprises a plurality of toner reservoirs from which the toner material is extracted little by little to fill a development device of the image generation device. The toner quantity extracted from each reservoir is separately detected for each reservoir.

An image generation device is known from U.S. Pat. No. 5,329,340 A that has two toner reservoirs, of which a first toner reservoir is arranged in a housing of the image generation device and a second toner reservoir is arranged in a separate housing. The second toner reservoir is connected with the image generation device via hoses. The second toner reservoir is used for refilling of the first toner reservoir.

A device for precise determination of the quantity of particulate material extracted from a reservoir, via which device the quantity of the material remaining in the reservoir is correctly determined, is known from U.S. 6,526,236 B1. The quantity of the particle reserve present in the reservoir is continuously determined with aid of a control unit.

A printer or copier system in which the quantity of toner material extracted from reservoirs is monitored specific to the reservoir is known from WO 00/19278. Material-specific information of the toner material contained in the reservoir is also associated with each reservoir, which material-specific information is used for control of the printing process. From this document it is also known to use a transponder as an information medium.

In general, in known printers or copiers it cannot be differentiated whether the reservoir is empty or whether an error of the toner transport system of the printer or copier is present when toner material is no longer conveyed from the reservoir. If the printer or copier detects that no toner material is transported from the reservoir, it marks the reservoir as empty in since information about the fill state "empty" of the reservoir is written on an information medium that is associated with the reservoir. Such an information medium can, for example, be contained in a transponder unit. The transponder unit is thus permanently connected with the reservoir, for example with a toner bottle. After the writing of this fill state information "empty, the reservoir can no longer be used even when toner material is actually still present in the reservoir. A reservoir is thus also marked as empty when problems occur in the toner transport in the toner transport system that prevent a toner transport from the reservoir, and the reservoir is marked as empty in spite of a sufficient reserve of toner material.

SUMMARY

It is an object of the invention to specify a method and an arrangement for transport of toner material in which it is determined in a simple manner whether toner material is contained in a reservoir of the printer or copier.

In a method and system for determination of a fill state of a transport reservoir for toner material, toner material is transported from a transport reservoir into a developer station with aid of a toner transport system of a printer or copier. At least a toner material quantity supplied to the developer station is detected. The detected toner material quantity is associated with the transport reservoir from which the toner material is extracted.

DESCRIPTION OF THE PREFERRED EMBODIMENT

Figure 1:
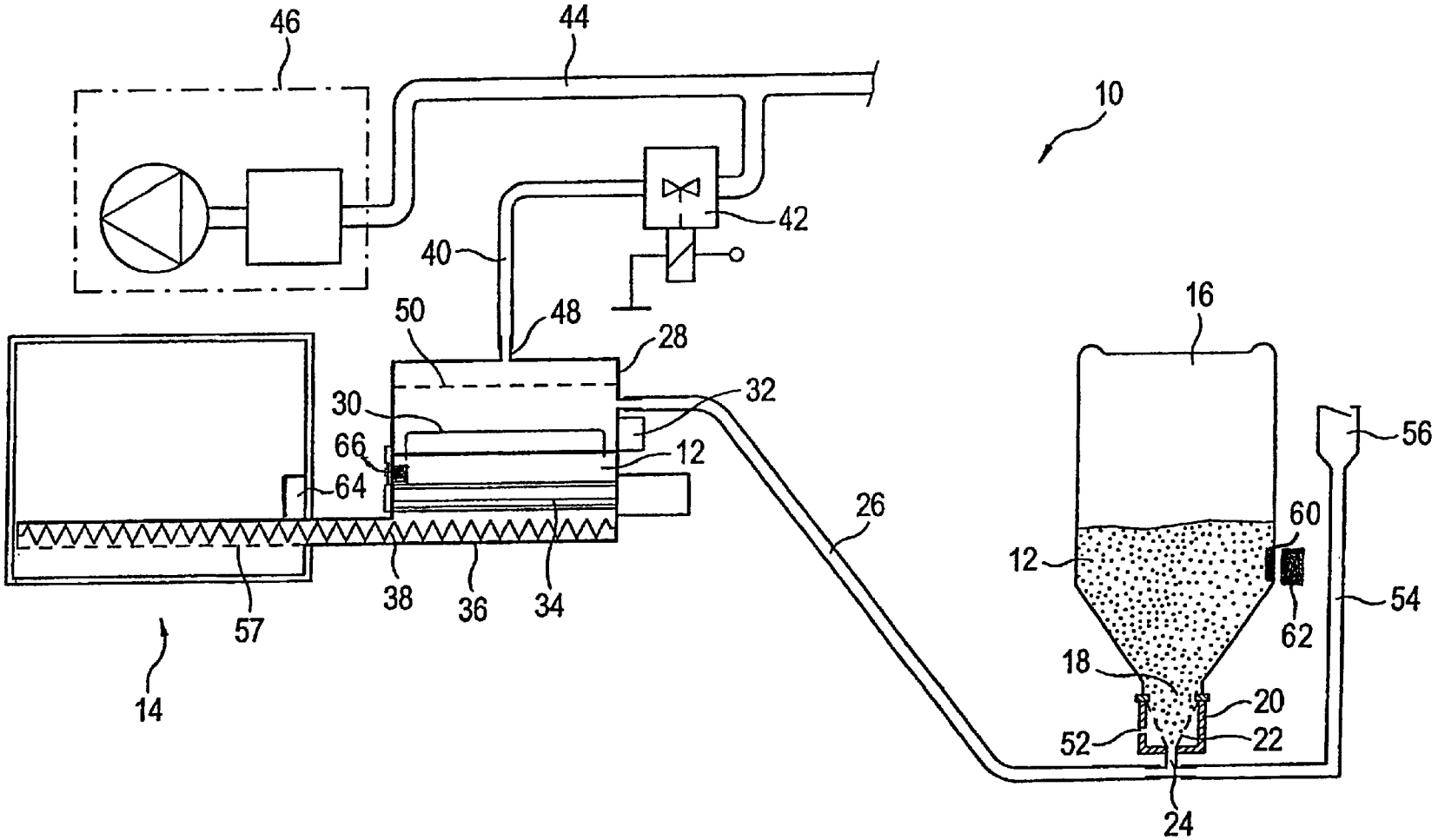
FIG. 1 shows a schematic design of a toner transport system in a printer or copier.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In particular via the detection of the toner material quantity extracted from the reservoir and the association of the detected toner material quantity with the reservoir from which the toner material is extracted, it is achieved with the preferred embodiment that information exists as to which toner material quantity has already been extracted from the reservoir, whereby an assessment of the fill level of the reservoir is possible in a simple manner.

A second aspect of the preferred embodiment concerns an arrangement for transport of toner material in an electrophotographic printer or copier. The arrangement comprises a toner transport system that transports toner material from a reservoir. The arrangement also comprises a device for detection of the toner material quantity extracted from the reservoir, whereby the detected toner material quantity can be associated with the reservoir from which the toner material has been extracted.

It is thereby achieved that the total quantity of toner material extracted from the reservoir can be determined in a simple manner and thus a reliable conclusion can be made about the fill level of the reservoir. A conclusion as to whether an error in the toner transport system of the printer or copier exists or whether toner material is no longer present in the reservoir can also in particular be made when toner material is no longer transported from the reservoir with the aid of the toner transport system.

A third aspect of the preferred embodiment concerns a method for transport of toner material in an electrophotographic printer or copier in which toner material is transported into the developer station from a reservoir after the under-run of a lower first limit value of a first toner material quantity present in a developer station. After the under-run of a lower second limit value of a second toner material quantity present in a reservoir, toner material is transported from a transport reservoir into the reservoir. At least the toner material transported from the reservoir to the developer station is detected. The detected toner material quantity is associated with the transport reservoir from which the toner material is extracted after the under-run of the second limit value, whereby the total quantity extracted from the transport reservoir is determined.

It is thus achieved that a quantity of toner material extracted from the transport reservoir is exactly detected and thus an exact conclusion can be made about whether toner material is still present in the transport reservoir or whether this is empty. Relatively small extraction quantities can also be exactly determined and associated with the transport reservoir via the selection of a suitable transport system between reservoir and developer station. The determined quantity of toner material that is transported between reservoir and developer station is preferably associated with the transport reservoir from which the quantity of toner material is extracted that is extracted from the transport reservoir to fill the reservoir. It is thus ensured that the exactly determined quantity of toner material is associated with the transport reservoir from which the toner material is extracted, if applicable with a time offset. An incorrect specification about the fill level of the transport reservoir can thus be prevented in a simple manner.

A fourth aspect of the preferred embodiment concerns an arrangement for transport of toner material in an electrophotographic printer or copier that comprises a first transport device, whereby the first transport device transports toner material from a reservoir into the developer station after the under-run of a lower first limit value of a first toner material quantity present in a developer station. The arrangement also comprises a second transport device that transports toner material from a transport reservoir into the reservoir after the under-run of a lower second limit value of a second toner material quantity present in the reservoir. Furthermore, the arrangement comprises a device for detection of a toner material quantity extracted from the transport reservoir (at least the toner material quantity transported from the reservoir to the developer station), whereby the detected toner material quantity can be associated with the transport reservoir from which the toner material is extracted after under-run of the second limit value.

Via this arrangement it is achieved that the quantity of toner material extracted from a transport reservoir can be precisely determined in a simple manner in order to make an exact conclusion, in particular with the aid of the second transport device, about whether an error of the toner transport exists or the transport reservoir is empty given an absent transport of toner material.

A toner transport system 10 of a printer or copier is shown in FIG. 1. The toner transport system 10 serves for supply of toner material 12 into a developer station 14. The toner material 12 is supplied to the printer or copier (not shown) in which the toner transport system 10 is contained via a transport reservoir 16 in which the toner material 12 is contained. An opening 18 of the transport reservoir 16 serves for extraction of toner material 12 from the transport reservoir 16. It is shown in a second, lower position, whereby the transport reservoir 16 is used in a position in which the opening 18 is located in an upper first position. A seal device 20 is connected toner-tight with the transport reservoir 16, such that toner material 12 slides from the transport reservoir 16 into the seal device 20. The seal device 20 also comprises a funnel 22 to accept and conduct the toner material 12 that slid into the seal device 20. The funnel 22 has a funnel outlet 24 that is connected air- and toner-tight with a tube system 26. The tube system 26 connects the funnel outlet 24 with a buffer (supply reservoir) 28 that is arranged near a developer station 14 and in which toner material 12 is buffered for further transport into the developer station 14. Both the buffer or supply reservoir 28 and the transport reservoir 16 are reservoirs in the sense of the.

The buffer or supply reservoir 28 comprises an agitation bow 30, fill level sensors 32, 64 and a dosing device 34 that comprises a paddlewheel. A toner transport tube 36 with a toner transport spiral 38 connects the buffer 28 with the developer station 14 and transports toner material 12 as needed from the buffer or supply reservoir 28 to the developer station 14. The quantity of toner material transported into the developer station 14 is adjusted and dosed with the aid of the dosing device 34 and/or the transport tube 36 that are respectively connected with an actuation device (not shown).

The agitation bow 30 mixes the toner material 12 in the buffer 28. The buffer 28 has a chamber sealed air-tight, which chamber is connected with a central negative pressure line 44 via a tube system 40 that comprises a magnet valve 42. A negative pressure is generated in the central negative pressure line 44 via a negative pressure blower 46. The tube system 40 is connected with an upper section of the buffer 28. Towards the sealed chamber a filter 50 is arranged below the connection point 48. The negative pressure in the tube system 40 as well as in the buffer 28 connected therewith and in the tube system 26 can be adjusted with the aid of a regulation valve 56. Via this negative pressure the toner material 12 is transported from the funnel outlet 24 of the seal device 20 into the buffer 28 via the tube system 26, whereby the transport capacity is in particular dependent on the negative pressure in the tube system 26.

The negative pressure in the tube system 26 is dependent on the adjustment of the regulation valve 56 and on the negative pressure in the negative pressure line 44. The suction air required for toner transport is thus set by the regulation valve 56 and by the negative pressure in the line 44. The toner material 12 leaving the funnel outlet 24 is carried away by the air current in the tube system 54, 26 and transported to the buffer 28. The filter 50 in the buffer 28 prevents the further transport of the toner material 12 in the tube system 40.

In the present exemplary embodiment, the valve 42 is activated and operated in 2-point operation. The transported quantity of toner material 12 is thereby dependent only on the negative pressure in the tube system 44 and the opening time of the regulation valve 42. In other exemplary embodiments, the valve 42 is a regulation valve that can be analogously adjusted in many positions, whereby the transport capacity can be simply adjusted and altered.

The funnel 22 has porous, air-permeable funnel walls. Air is drawn into the funnel 22 through the funnel walls from the seal device 20 due to the negative pressure at the funnel outlet 24. In the funnel 22 a toner-air mixture is thereby generated that achieves a fluid-like state and has what are known as fluid properties. This air (that is drawn into the funnel 22 with the aid of the negative pressure as described) is directed over an opening 52 in the seal device 20. The air supplied via the opening 52 can be controlled via a valve (not shown). The funnel outlet 24 is also connected via a tube system 54 with the regulation valve 56 via which external air can be fed to the tube system 54, 26. A reaction valve is also arranged downstream from the regulation valve 56, whereby an escape of toner material is also prevented given disadvantageous pressure relationships in the tube systems 42, 26, 54. The transport capacity with which the toner material 12 is transported from the transport reservoir 16 into the buffer 28 can also be adjusted with the aid of the regulation valve 56.

The toner transport from the reservoir 16 into the buffer supply reservoir 28 is controlled corresponding to the signal of the fill level sensor 32. For this the valve 42 is opened completely for a predetermined time duration, whereby a predetermined quantity of toner material 12 is transported from the transport reservoir 16 via the tube system 26 into the buffer 28. The transport of the toner material for the preset time duration is also designated as a transport cycle or transport action.

As already mentioned, the toner material 12 is transported from the buffer 28 into the developer station 14 with the aid of the transport tube 36. The transport tube 36 protrudes with one end into the developer station 14 and has wide openings on an underside 57 at this end, through which openings the toner material 12 falls from the transport tube 36 into the developer station 14.

The transport spiral 38 contained in the transport tube 36 has a slope such that it transports toner material 12 in the transport tube 36 similar to a screw conveyor tube from the buffer 28 to the developer station 14. The transport spiral 38 is, as already mentioned, driven with the aid of a drive unit. The dosing device 34 contains a paddlewheel-like roller that is arranged between the buffer 28 and the transport tube 36. Such a dosing device 34 is also designated as a cell wheel sluice. The paddlewheel-like roller seals the buffer 28 from the transport tube 36 nearly airtight, such that air is drawn from the tube system 26 given the generation of a negative pressure with the aid of the negative pressure blower 46. The paddlewheel-like roller is preferably driven synchronously with the transport spiral 38, whereby, given a rotation of the paddlewheel-like roller (that is also designated as a cell wheel), toner material falls from the buffer 28 into the bucket chambers or cells and is transported downwards to the transport tube 36 by the rotation.

Below the dosing device 34, the transport tube 36 has an opening at the top towards the dosing device 34 such that the toner material 12 falls from the cells downwards into the transport tube 36. The agitation bow 30 inside the buffer 28 is driven with the aid of a drive unit (not shown) and, via a rotation, prevents a hollow formation or cornice formation in the toner material 12 of the buffer 28.

The transport reservoir 16 also comprises a transponder unit 60, whereby information about toner parameters of the toner material 12 (such as, for example, toner type, toner color, stability of the toner material 12) as well as information about the fill quantity, the quantity already extracted and the fill level (i.e. about the presence of toner material in the transport reservoir 16) are stored in a storage region of the transponder unit 60. The transport reservoir 16 is preferably a toner reserve bottle in which a quantity of toner material 12 in a range between 200 g and 10 kg is located in the filled state. The communication between a control unit of the printer or copier and the transponder unit 60 occurs with the aid of a transponder component 62.

The developer station 14 comprises a toner concentration sensor 64 that emits a signal to the control unit of the printer or copier given an under-run of a predetermined limit value of the toner concentration in the developer station 14, which signal activates the drive unit of the dosing device 34 and the transport spindle 38 of the transport tube 36 for a predetermined time period given an under-run of the toner concentration. Thus toner material 12 is transported from the buffer 28 to the developer station 14 for this time period. The transport for the specific time period is designated as a transport cycle or transport action.

If, after the transport of toner material 12 into the developer station 14, the toner concentration sensor 64 detects that the toner concentration is still below the preset limit value, a further transport cycle is activated by the control unit of the printer or copier. The drive units of the transport spiral 38 and the dosing device 34 have a constant rotation speed, such that a preset quantity of toner material is transported from the buffer 28 into the developer station 14 in a predetermined time period, i.e. in one transport cycle. In addition to the fill level sensor 32, the buffer 28 comprises a fill level sensor 66 that detects the under-run of a lower minimal fill level of toner material in the buffer 28. If the fill level sensor 66 detects that the minimal fill level has been under-run, a transport cycle is no longer triggered by the control unit. If the toner concentration sensor 64 subsequently determines that a too-low toner concentration is present in the developer station 14, at least the printing unit associated with the developer station 14 is stopped and an error message is output to a control unit of the printer or copier.

The toner concentration sensor 64 determines the ratio of the toner material in a toner material-carrier particle mixture present in the developer station 14, which toner material-carrier particle mixture serves for development of a latent charge image located on a photoconductor.

If the fill level sensor 32 determines that a preset toner quantity has been under-run in the buffer 28, as already described toner material is transported from the transport reservoir 16 into the buffer 28 with the aid of a negative pressure. If toner material 12 is no longer present in the transport reservoir 16 or if the transport reservoir 16 was, for example, removed from the printer or copier for exchange with a full transport reservoir 16, toner material can furthermore be transported from the buffer 28 into the developer station 14 until the fill level sensor 66 determines that the lower minimal limit value has been under-run.

Figure 2:
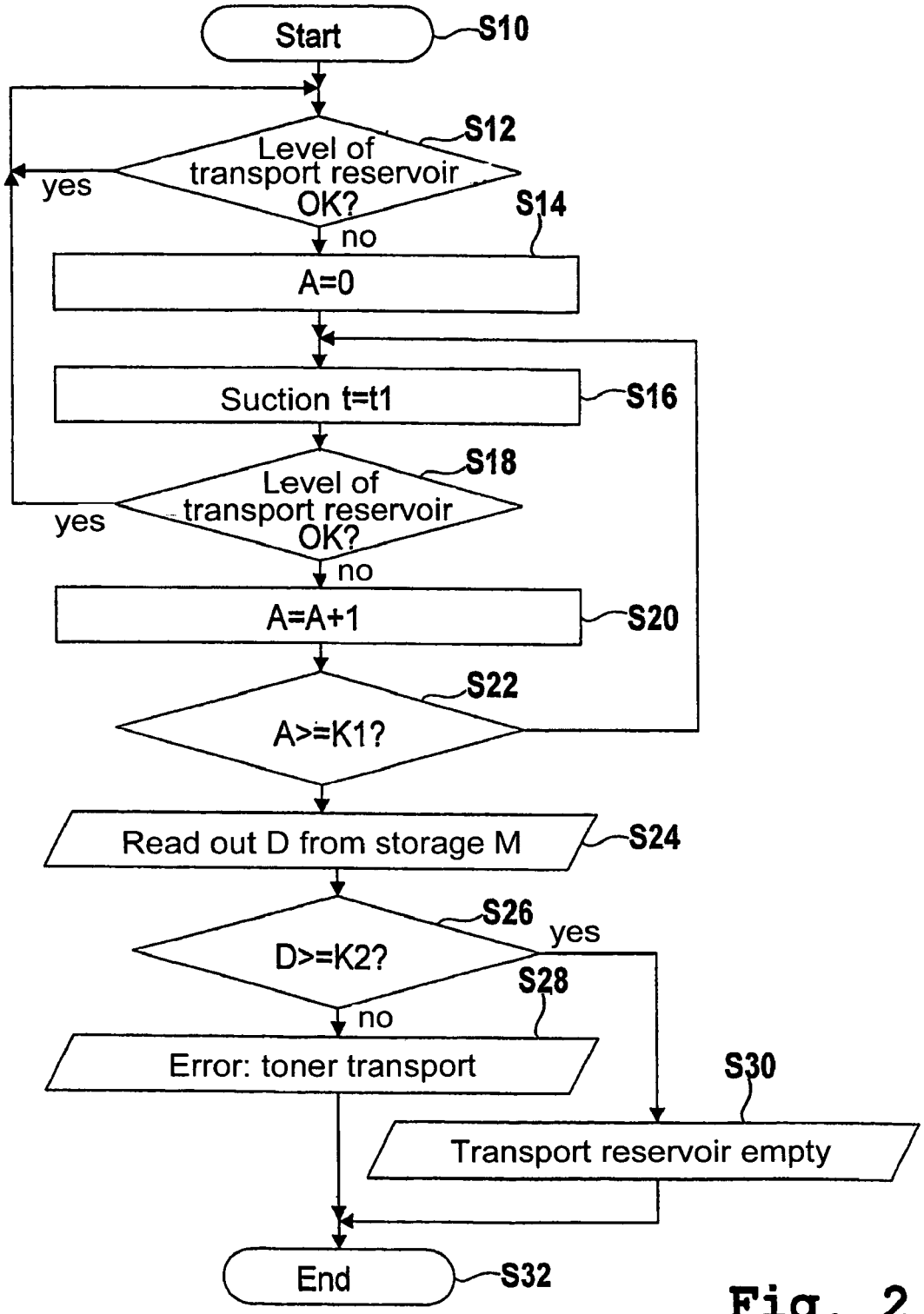
FIG. 2 shows a workflow plan with method steps for determining a cause given the absence of a toner material transport, whereby it is determined whether a transport reservoir from which toner material is extracted is empty.

A workflow plan with method steps for control of the toner transport system 10 according to FIG. 1 is shown in FIG. 2. Identical elements have identical reference characters. The workflow is started in step S10. In step S12, with the aid of the fill level sensor 32, it is subsequently checked whether a sufficient fill level of toner material 12 is present in the buffer 28 and a lower limit value has not been under-run. If this is the case, the process branches back to the step S12, whereupon it is repeatedly checked whether sufficient toner material 12 is contained in the buffer 28. If, in step S12, it is established that sufficient toner material 12 is no longer present in the buffer 28, the initialization value 0 is assigned to a variable A, whereby the variable A serves for counting of the transport cycles between the transport reservoir 16 and the buffer 28. In a step S16, toner material 12 is subsequently transported from the transport reservoir 16 via the tube system 26 into the buffer 28 for a predetermined time period t1. The valve 42 is thereby fully open for the time period t1. The valve 42 is thereby a magnet valve that is operated in 2-point operation.

In step S18, it is subsequently checked whether the lower limit value in the buffer 28 has been exceeded again, i.e. whether the fill level of the toner material present in the buffer 28 again exceeds the limit value detected by the fill level sensor 32. If this is the case, the process branches back to step S12. If this is not the case, in step S20 the variable A is subsequently incremented by the amount 1. In step S22 it is subsequently checked whether the variable A is greater than or equal to a constant K1. If this is not the case, the process branches back to the step S16, whereupon in step S16 the valve 42 is opened again for a predetermined time period t1 and thus a second transport cycle is conducted for transport of toner material 12 from the transport reservoir 16 into the buffer 28.

If, in step S22, it is established that the variable A is equal to the constant K1, whereby K1 is preferably set to a value in the range between 2 and 20, in step S24 a value of a variable D is thus read from the storage range M of the transponder unit 60 of the transport reservoir 16. In step S26 it is subsequently checked whether the read value of the variables D is greater than or equal to the value of a constant K2. The value thereby specifies (specific to the printer and dependent on the transport reservoir) the number of the transport cycles for transport of toner material from the buffer 28 into the developer station 14 that are required at a minimum in order to transport the entirety of the toner material 12 located in transport reservoir 16 from the buffer 28 into the developer station 14.

If the limit value is exceeded or under-run, in step S30 a message is subsequently output that the transport reservoir 16 is empty. The control unit of the printer or copier can thereupon output an error message to a control unit or activate the transport of toner material 12 from a further transport reservoir 16. However, if in step S26 it is established that the value of the variable D is not greater than or equal to the value of the constant K2, in step S28 an error message to signal the error of the toner transport is subsequently generated via which the controller independently takes measures to correct the error and/or said error message is output on a control unit of the printer or copier. If, given a comparison in step S26, it is established that the value of the variable is greater than or equal to the constant K2, a status value that specifies that the reservoir 16 is empty is written in a storage range of the transponder unit 60. The workflow is ended in the step S32 after the step S28 or S30.

Figure 3:
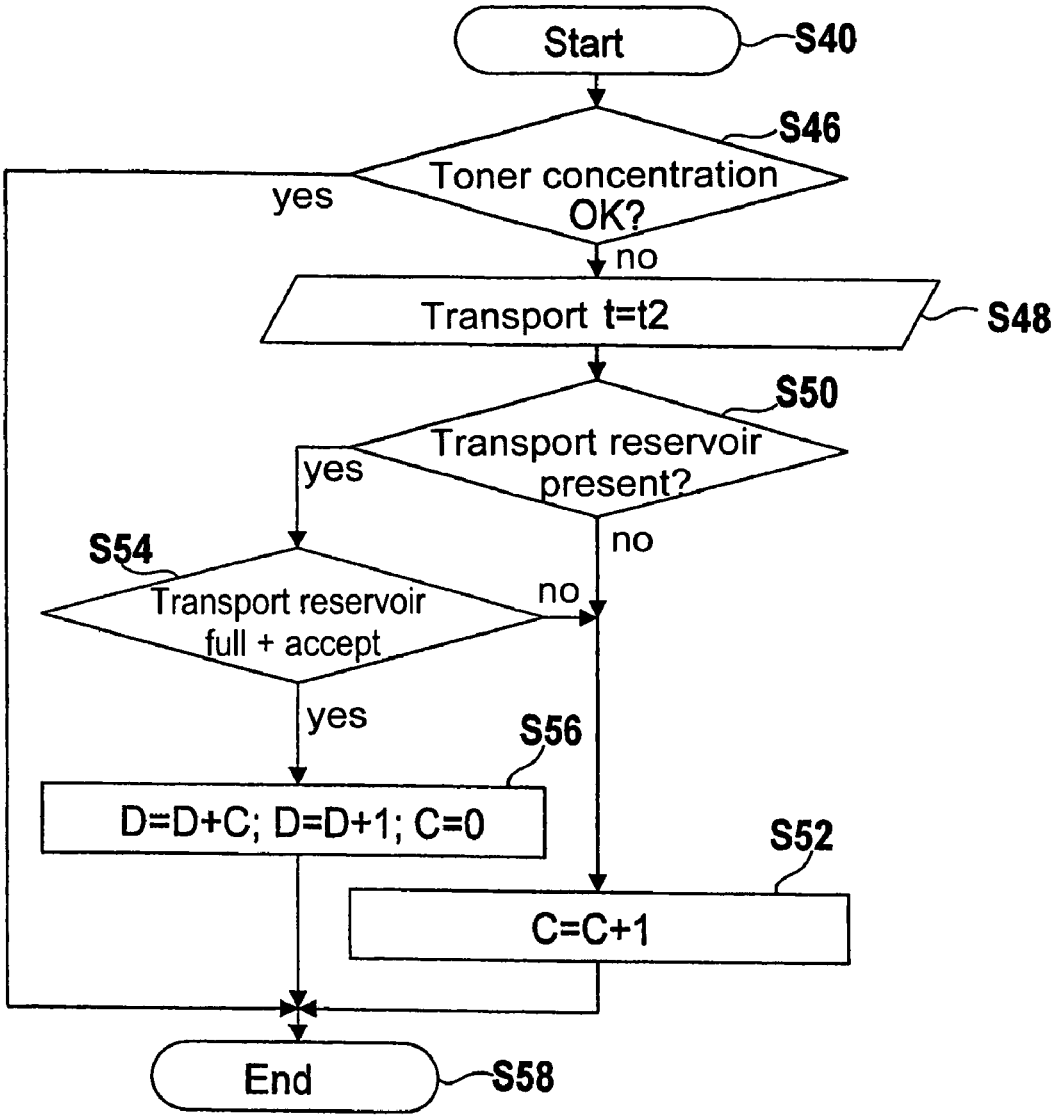
FIG. 3 illustrates a workflow plan with method steps for association of a determined toner quantity with a transport reservoir.

A workflow plan with method steps for association with a transport reservoir 16 of the quantity of toner material transported from the buffer 28 to the developer station 14 is shown in FIG. 3. The workflow is started in step S40. In step S46, the toner concentration in the developer station 14 is subsequently determined with the aid of a toner concentration sensor 64. If, in step S46, it is established that the toner concentration in the developer station 14 has not yet under-run a limit value, the workflow is ended in a step S58. However if, in step S46, it is established that the toner concentration has under-run the preset value, in step S48 toner material 12 is subsequently transported (as already described further above) into the developer station 14 for a time period t2 with the aid of the dosing device 34 and the transport tube 38. In step S50 it is subsequently checked whether a transport reservoir 16 is present in the printer or copier. The presence of a transport reservoir 16 in the printer or copier is detected with the aid of the transponder component 62 and signaled to the control unit of the printer or copier. If, with the aid of the transponder component 62 it is detected in step S50 that no transport reservoir 16 is present in the printer or copier, the variable C is incremented by the value 1 in step S52. The number of the transport cycles that are implemented without a transport reservoir 16 being present in the printer or copier is thus detected with the aid of the variable C. The workflow is subsequently ended in step S58.

However, if in step S50 it is established that a transport reservoir 16 is present in the printer or copier, toner parameters and parameters of the transport reservoir 16 are subsequently read out from a storage range of the transport unit 16 with the aid of transponder component 62, which toner parameters and parameters of the transport reservoir 16 are compared in step S54 with minimum parameters preset in the printer or copier. In step S54, information as to whether the status empty" has already been associated with the transport reservoir 16 is also read out from the storage range of the transponder unit 60. If, in step S54, it is established that the transport reservoir 16 is not full or that the minimum requirements of the toner material 12 contained in the transport reservoir 16 are not satisfied, the process subsequently branches to step S52 in which, as already described, the variable C is incremented by the value 1. Also, in one step (not shown) it is prevented that toner material 12 is transported from the transport reservoir 16 into the buffer 28.

If, in a step S54, it is established that the toner material 12 in the transport reservoir 16 satisfies the minimum requirements and that the transport reservoir 16 does not have the status "empty", i.e. that the transport reservoir 16 at least still contains toner material, in step S56 the value of the variable D is thus subsequently picked out from a storage range of the transponder unit 62 of the transport reservoir 16 and increased by the value of the variable C. The value of the variable D is subsequently incremented by 1, whereby the transport cycle executed in the step S48 is registered. After the addition of the value of the variable C, the value of the variable C is also set to the value 0. The process is subsequently ended in step S58.

The method workflow according to FIG. 3 is continuously executed by the controller of the printer or copier and serves to ensure a sufficient toner concentration in the developer station 14 as well as for the correct association with the transport reservoir 16 of the quantity (detected with the aid of the transport cycles) of the toner quantity transported from the buffer 28 to the developer station 14, to which transport reservoir 16 the toner material 12 is subsequently transported to fill the buffer 28 after the transport of the toner material from the buffer 28 into the developer station 14. The subsequent transport of the toner material 12 from the transport reservoir 16 into the buffer 28 is, as already explained, controlled with the aid of the fill level sensor 32.

Via the method workflow according to FIG. 3 it is achieved that, after the insertion of a new, correct transport reservoir 16, the toner material quantity already transported from the buffer 28 into the developer station 14 is associated with the subsequently inserted transport reservoir 16 since the quantity of toner material required to fill the buffer 28 is extracted from the transport reservoir 16. In particular due to the arrangements of the dosing device 34 and the transport tube 36, the transported toner quantity can be very precisely determined using the transport cycles, whereby the quantity of toner material 12 extracted from the transport reservoir 16 is very exactly and reliably determined.

The value of the variable C thus serves as an internal transport cycle counter that is always activated when no new value of the variable D is written to the transponder unit 60 of the transport reservoir 16, or the value of the variable D cannot be read. This is always the case when the transport reservoir 16 is already marked as "empty" or no transport reservoir 16 is present in the printer or copier. This is in particular the case when a previously-inserted transport reservoir 16 is extracted from the printer or copier for exchange of the transport reservoir 16 during the operation of the printer or copier and no new transport reservoir 16 has yet been inserted into the printer or copier. Given an activated internal transport cycle counter, all executed transport cycles in which toner material is transported from the buffer 28 into the developer station 14 are recorded by the internal transport cycle counter in that the value of the variable C is incremented by the value 1 after each transport cycle.

If a new transport reservoir 16 is subsequently inserted into the printer or copier and if this transport reservoir 16 is accepted by the printer or copier after it has been checked whether the inserted transport reservoir 16 does not have the fill level status "empty" and the transport reservoir 16 contains correct toner material 12, toner material is transported from the transport reservoir 16 into the buffer 28 when the limit value detected by the fill level sensor 32 is under-run. This toner transport likewise occurs in transport cycles as they were already explained in connection with FIGS. 1 and 2. If the quantity of toner material in the buffer is at least filled such that the lower limit value detected by the fill level sensor 32 is exceeded again, the count value of the internal transport cycle counter is added to the value of the variable D stored in the transponder unit 60 (step S56), whereby the value of the internal transport cycle counter is subsequently reset via overwriting the count value of the variable C with the value 0. The subsequent transport cycles are directly registered via incrementing of the variable D in the storage range of the transponder unit 60 of the transport reservoir 16.

A defined transport pause with present length advantageously occurs between two transport cycles before a further transport cycle is activated, both given the transport cycles for transport of toner material 12 from the transport reservoir 16 into the buffer 28 and given transport cycles for transport of toner material 12 from the buffer 2 into the developer station 14. The variable D, the constants K1, K2 and/or the time duration t1, t2 are advantageously stored in a storage range of the transponder unit 60.

In other embodiments, the quantity of toner material 12 that is extracted from the transport reservoir 16 via the suction line 26 with the aid of the toner transport system 10 is directly detected. In practice, however, the toner material quantities transported from the transport reservoir 16 fluctuates very severely, in particular over a longer usage duration of the printer or copier, such that a further measurement arrangement to exactly determine the transported toner material quantity is then required for a correct conclusion about the transported quantity of toner material 12.

In contrast to this, the quantity of toner material 12 that is transported by the transport tube 36 with the aid of the transport spindle 38 can simply be determined by the revolutions of the drive unit of the transport spindle 38. If the transport spindle 38 is driven by a drive unit with a constant rotation speed, the transported quantity of toner material 12 is constant per unit of time, such that the transported quantity of toner material 12 can be determined via the total transport time. If the transport with the aid of the transport spindle 38 occurs with the aid of transport cycles with a fixed cycle duration, the transported quantity of toner material can thus also be exactly determined by the number of the transport cycles.

As already explained, the fill level status of the transport reservoir 16 is stored in a storage range of the transponder unit 60, i.e. the state transport reservoir 16 "empty" or transport reservoir 16 "not empty" is stored. This state information can, for example, be stored as a binary value. Manipulations of the transport reservoir 16, for example via refilling of another toner material, are thereby effectively prevented. Via the method steps explained in FIGS. 2 and 3 it is also prevented that a transport reservoir 16 in which toner material 12 is still present is marked as "empty" given an error in the toner transport system 10 of the printer or copier.

Although a preferred exemplary embodiment of the invention is shown and described in detail in the drawings and the preceding specification, this should be viewed as purely exemplary and not as limiting the application. It is noted that only the preferred exemplary embodiment is shown and described, and all variations and modifications should be protected that presently and in the future lie within the protective scope of the invention.

We claim:

1. A method for transport of toner material in an electrophotographic printer or copier, comprising the steps of:

transporting toner material from a supply reservoir into a developer station after an under-run of a lower first limit value by a first toner material quantity present in said developer station;

transporting toner material from a transport reservoir into said supply reservoir after an under-run of a lower second limit value of a second toner material quantity present in said supply reservoir;

detecting and storing at least a quantity of said toner material transported from said supply reservoir to said developer station when said lower second limit value is under-run; and associating said detected and stored toner material quantity with said transport reservoir from which said toner material is extracted to fill said supply reservoir after said under-run of said second limit value, said associating lasting at least until said lower second limit value is reached.

2. A method according to claim 1 wherein the toner material quantity is detected without the transport reservoir from which toner material is transported into the supply reservoir being present in the printer or copier associated with the subsequently provided transport reservoir.

3. A method according to claim 1 wherein after the under-run of the lower second limit value, toner material is transported from the transport reservoir into the supply reservoir at least until the lower second limit value is exceeded.

4. A method according to claim 1 wherein after the under-run of the lower second limit value, toner material is continued to be transported from the transport reservoir into the supply reservoir until an upper third limit value is reached or exceeded.

5. A method according to claim 4 wherein the detected and stored toner material quantity is compared with a fourth limit value associated with the transport reservoir, the transport reservoir being identified as empty upon reaching or exceeding the fourth limit value.

6. A method according to claim 5 wherein state information that specifies whether toner material is present in the transport reservoir is stored in a storage range associated with the transport reservoir.

7. A method according to claim 5 wherein a number of transport actions associated with the transport reservoir is only compared with the fourth limit value after the third limit value has not been reached after a preset transport time or after a preset number of transport actions.

8. A method according to claim 7 wherein the preset transport time is determined from the number of transport actions with preset duration.

9. A method according to claim 5 wherein no toner material is transported from the transport reservoir when state information specifies that toner material is no longer contained in the transport reservoir.

10. A method according to claim 1 wherein the detected and stored toner material quantity is determined with aid of a toner concentration of a toner material-carrier particle mixture present in the developer station, the first lower limit value being a minimum toner concentration of the toner material-carrier particle mixture.

11. A method according to claim 1 wherein the supply reservoir comprises a buffer.

12. A method according to claim 1 wherein a preset quantity of a temperature measurement event is transported from the reservoir into the developer station after the under-run of the minimum quantity of toner material in the developer station.

13. A method according to claim 12 wherein the preset quantity is established via a control of a transport duration, the transport capacity being substantially constant.

14. A method according to claim 13 wherein the transport duration is rigidly set for a transport action in the printer or copier.

15. A method according to claim 14 wherein a number of the transport actions per reservoir is detected.

16. A method according to claim 12 wherein at least in one region, the preset quantity of toner material is transported with aid of a paddlewheel or a transport spindle from the supply reservoir into the developer station, the transported quantity being determined with aid of rotations of the paddlewheel or of the transport spindle.

17. A method according to claim 16 wherein a number of the rotations for a transport action is rigidly set in the printer or copier.

18. A method according to claim 17 wherein the number of the rotations per transport action is controlled with aid of the transport duration given a substantially constant drive rotation speed of the paddlewheel or of the transport spindle.

19. A method according to claim 18 wherein the number of the transport actions is detected per reservoir.

20. A method according to claim 1 wherein the toner material is transported with aid of a preset negative pressure.

21. A method according to claim 1 wherein at least one further transport action is implemented when a minimum quantity of a temperature measurement event in the developer station is not achieved or exceeded after a transport action.

22. A system for transport of toner material in an electrophotographic or copier, comprising:

a first transport device that transports toner material from a supply reservoir into a developer station after an under-run of a lower first limit value of a first toner material quantity present in the developer station;

a second transport device that transports toner material from a transport reservoir into said supply reservoir after an under-run of a lower second limit value by a second toner material quantity present in said supply reservoir;

a detection device that detects a toner material quantity transported from said supply reservoir to said developer station when said lower second limit value is under-run; and an association device which associates said detected toner material quantity with said transport reservoir from which said toner material is extracted after said under-run of said lower second limit value, said association being maintained at least until said second lower limit value is reached.

23. A system according to claim 22 wherein the transport reservoir comprises an information medium on which at least a total number of transport actions associated with the transport reservoir or a possible number of transport actions is applied as a limit value.

24. A method for determination of a fill state of a transport reservoir for toner material, comprising the steps of:

transporting toner material from a transport reservoir into a developer station with aid of a toner transport system of a printer or copier;

detecting at least a toner material quantity supplied to the developer station by use of a number of implemented transport actions;

associating the detected transport actions with the transport reservoir from which the toner material is extracted for supply of the extracted toner material quantity; and only then comparing said number of implemented transport actions associated with the transport reservoir with a limit value after a minimum quantity of toner material in the developer station or a further reservoir has not been reached after a preset number of successively implemented transport actions for transport of toner material from the transport reservoir.

25. A method according to claim 24 wherein the transport reservoir is identified as empty after reaching or exceeding the limit value of the transport reservoir.

26. A method according to claim 25 wherein state information that specifies whether toner material is present in the transport reservoir is stored in a storage region associated with the transport reservoir.

27. A system for determination of a fill state of a transport reservoir for toner material with a toner transport system that transports toner material from a transport reservoir into a developer station, comprising:

a device to detect, with aid of a number of implemented transport actions, a toner material quantity supplied to the developer station;

a compensating unit to compare the number of the implemented transport actions associated with the transport reservoir with a limit value, the comparison only being conducted after a minimum quantity of toner material in the developer station or in a supply reservoir as a buffer has not been reached after a preset number of successively implemented transport actions, a storage region being associated with the transport reservoir and in which state information can be stored, said state information specifying whether toner material is present in the transport reservoir; and state information that specifies an empty state being stored upon reaching or exceeding the limit value.

* * * * *